US005244398A

United States Patent [19]

Chou

[11] Patent Number: 5,244,398

[45] Date of Patent: Sep. 14, 1993

[54] SAFETY RECEPTACLE

[76] Inventor: Jonie Chou, No. 53, Hsin Fu Rd., Panchaio City, Taipei Hsien, Taiwan

[21] Appl. No.: 943,696

[22] Filed: Sep. 11, 1992

[51] Int. Cl.[5] ..... H01R 13/44

[52] U.S. Cl. ..... 439/143; 439/145

[58] Field of Search ..... 439/142, 143, 145, 148, 439/149

[56] References Cited

U.S. PATENT DOCUMENTS 4,072,382 2/1978 Reschke ..... 439/143

4,435,032 3/1984 Abramson et al. ..... 439/145

FOREIGN PATENT DOCUMENTS 2233509 1/1991 United Kingdom ..... 439/145

*Primary Examiner*—Larry I. Schwartz

*Assistant Examiner*—Hien D. Vu

*Attorney, Agent, or Firm*—Bacon & Thomas

[57] ABSTRACT

A safety receptacle includes a hot terminal and a neutral terminal disposed above two slots on a front cover and separated by a division plate, which is made from an elastic insulating material having two symmetrical bevel side walls, each of which being terminated into an outward root wall for separating each terminal from its slot. Inserting the blades of a plug into the slots causes the outward root walls to be squeezed inwardly for permitting the blades to be electrically connected to the terminals.

1 Claim, 3 Drawing Sheets

SAFETY RECEPTACLE

BACKGROUND OF THE INVENTION

The present invention relates to electric receptacles and relates more particularly to a safety receptacle.

An electric receptacle is generally comprised of a hot terminal and a neutral terminal disposed behind a respective slot on a front cover for connecting the two blades of an electric plug. A grounding terminal may be used for connecting the grounding prong of an electric plug. However, this structure of electric receptacle is not safe in use. If a child inserts a conductor into the slots, an electric shock may happen.

SUMMARY OF THE INVENTION

The present invention eliminates the aforesaid problem. It is therefore the main object of the present invention to provide an electric receptacle which is safe in use. According to the preferred embodiment of the present invention, the insulating division plate which separates the hot terminal from the neutral terminal is made from an elastic insulating material having two symmetrical bevel side walls, each of which is terminated into an outward root wall in separating either terminal from either slot. Inserting the blades of a plug into the slots causes the outward root wall to be squeezed inwards for permitting the blades to be electrically and respectively connected to either terminal.

DETAILED DESCRIPTION OF THE PREFERRED EMBODIMENT

Figure 1:
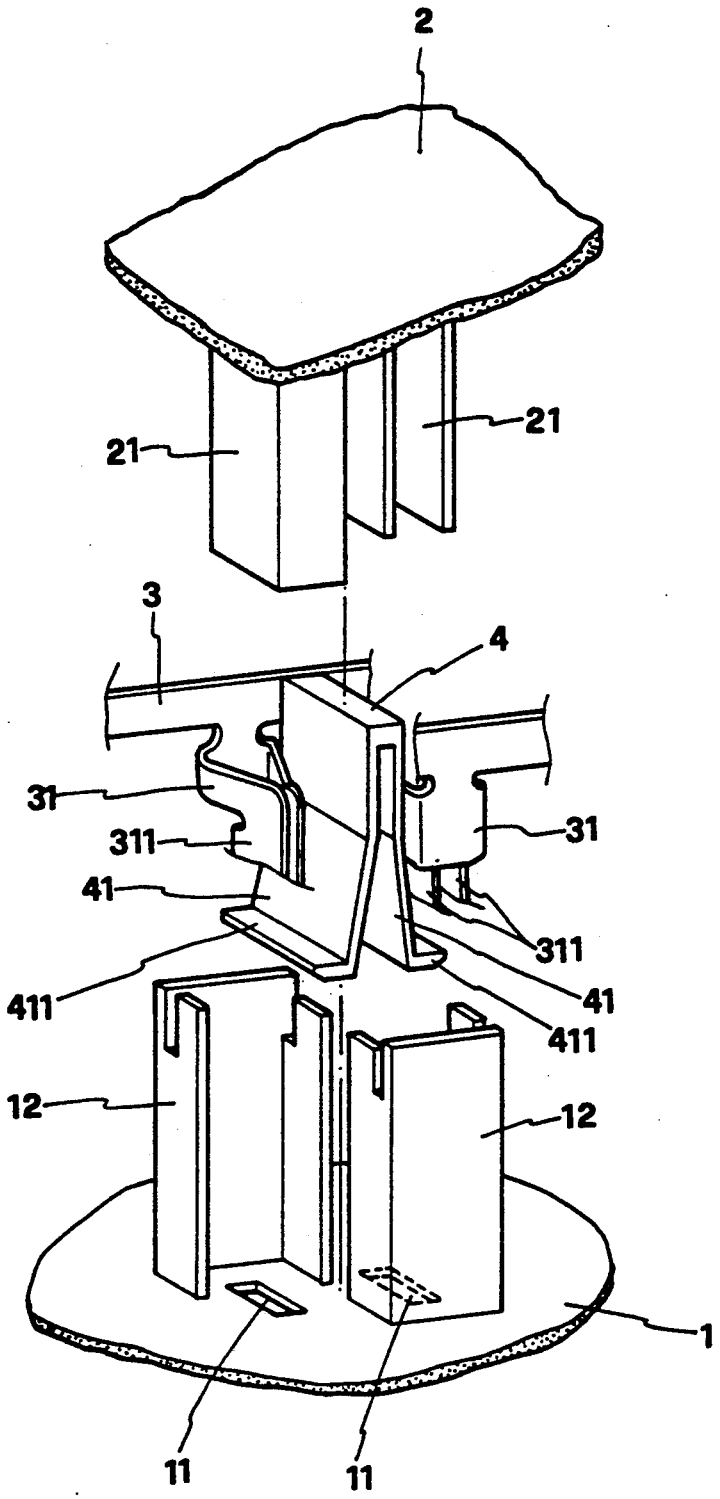
FIG. 1 is an exploded view of the preferred embodiment of the safety receptacle of the present invention.

Referring to FIG. 1, a safety receptacle as constructed in accordance with the present invention is generally comprised of a front cover 1, a back cover 2, two terminals 3 (hot terminal and neutral terminal), and a division plate 4. The front cover 1 is made from an insulating material having two slots 11 through which the blades of an electric plug may each be respectively inserted, and a plurality of perpendicular rib walls 12. The back cover 2 is made from an insulating material having perpendicular rib walls 21 corresponding to the perpendicular rib walls 12 on the front cover 1. The terminals 3 include one connected to the hot wire and the other connected to the neutral wire. Each terminal 3 has a front end 31 formed into two clamping tips 311 for receiving its respective blade of the inserted plug. The division plate 4 is made from an elastic insulating material bent into shape, and comprising two symmetrical side walls 41 obliquely and downwardly extended from a closed top thereof. The two side walls 41 of the division plate 4 each has a top end connected to each other and a bottom end bent into an outward root wall 411. The outward root wall 411 of each side wall 41 has a bevel bottom edge (not shown) sloping outwardly upwards. When assembled, the outward root wall 411 of each side wall 41 is covered over the respective slot 11 on the front cover 1.

Figure 2:
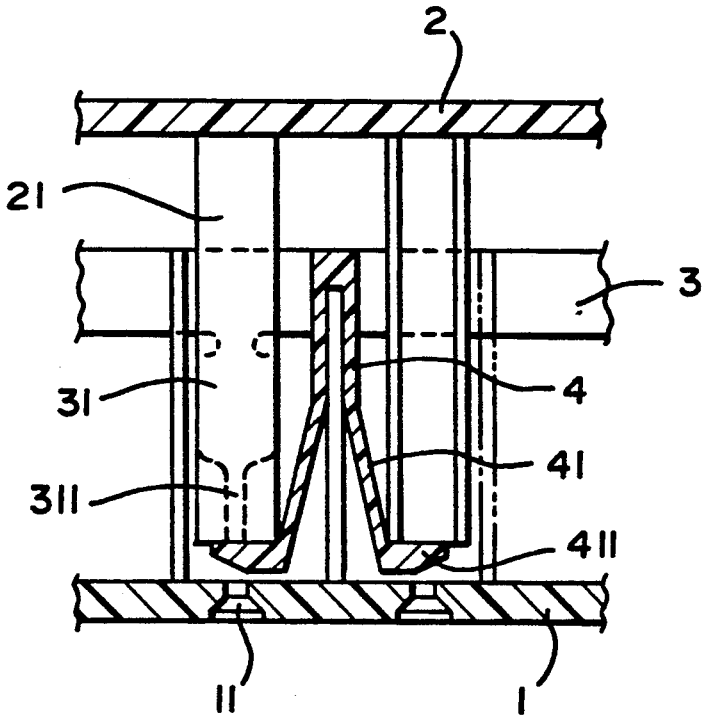
FIG. 2 is a schematic sectional view thereof.
Figure 3:
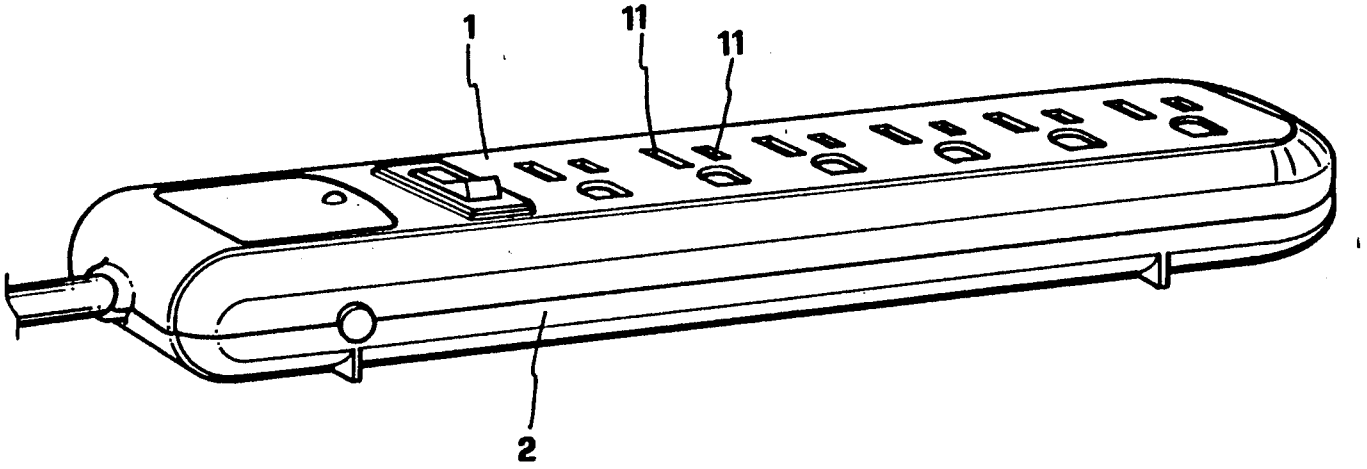
FIG. 3 is an elevational view showing the outer appearance of the safety receptacle.

Referring to FIG. 2, the two terminals 3 are separated by the division plate 4 and received inside either rib wall 12 on the front cover 1 above the respective slot 11, and the two side walls 41 of the division plate 4 are respectively inserted into either rib wall 12. Inserting the two blades of a plug into the slots 11 causes the outward root wall 411 of each side wall 41 of the division plate 4 to be respectively squeezed inwardly toward each other for permitting the two blades of the plug to be respectively inserted into the space between the two clamping tips 311 of either terminal 3 and electrically connected to either terminal 3. As the plug is removed from the front cover 1, the elastic material property of the division plate 4 forces the side walls 41 to move the respective outward root wall 411 back to its former position in covering over either slot 11. If a child inserts a conductor into either slot 11 on its front cover, it is prohibited from contacting the respective terminal 3 by the respective outward root wall 411. Therefore, the receptacle is safe in use.

The preferred embodiment described is simple in structure and therefore functional. However, it will be obvious to those skilled in the art that various changes and modifications could be made without departing from the scope of the invention and the invention is not to be considered limited to what is shown in the drawings and described in the specification. For examples, the number of the slots 11 on the front cover 1 may be increased for inserting more plugs. As the number of the slots 11 is increased, the number of the division plate 4 and the terminals shall be increased relatively.

What is claimed is:

1. A safety receptacle comprising:

a front cover made from an insulating material having at least one set of slots, through which blades of an electric plug are respectively inserted, and a plurality of perpendicular rib walls respectively disposed adjacently to each slot;

a back cover made from an insulating material and having a plurality of perpendicular rib walls respectively matching with the perpendicular rib walls on said front cover;

at least one pair of terminals respectively connected to positive and negative ends of a power supply and disposed above the slots on said front cover, each terminal having a front end formed into two clamping tips spaced above either slot on said front cover; and at least one separate division plate respectively made from an elastic insulating material and disposed between the pair of terminals, each division plate comprising two symmetrical side walls obliquely and downwardly extended from a closed top thereof, each side wall having a bottom end bent into an outward root wall, the outward root walls being disposed above the slots and below the terminals for covering the slots, and the outward root wall of each side wall having a sloping bottom edge.

* * * * *